US005225732A

United States Patent [19]

Watanabe et al.

[11] Patent Number: 5,225,732

[45] Date of Patent: Jul. 6, 1993

[54] GAS DISCHARGE-TYPE DISPLAY PANEL COMPRISING A COMPOSITE OXIDE CATHODE

[75] Inventors: Yoshio Watanabe, Yokohama; Toshiharu Hoshi, Kawasaki, both of Japan

[73] Assignee: Matsushita Electric Industrial Co., Ltd., Osaka, Japan

[21] Appl. No.: 679,471

[22] Filed: Apr. 2, 1991

[30] Foreign Application Priority Data

Apr. 2, 1990 [JP] Japan ..... 2-87919
Nov. 28, 1990 [JP] Japan ..... 2-332397

[51] Int. Cl.[5] ..... H01J 17/06
[52] U.S. Cl. ..... 313/582; 313/584
[58] Field of Search ..... 313/582, 583, 584

[56] References Cited

U.S. PATENT DOCUMENTS 4,520,290 5/1985 Cokefair ..... 313/583

FOREIGN PATENT DOCUMENTS 64149 11/1982 European Pat. Off. .
160459 11/1985 European Pat. Off. .

OTHER PUBLICATIONS

"Putting Into Low Voltage of DC Type Gas Discharge Display Panel" by S. Watanabe et al; IPD 59-10, Jun. 1981; Television Society.

Patent Abstracts of Japan vol. 13, No. 330 (E-793)(3678) Jul. 25, 1989 & JP-A-1 95 435 (Matsushita Electric Ind. Co. Ltd.) Apr. 13, 1989 *the whole document*.

Japanese Journal of Applied Physics, vol. 26, No. 10, Oct. 1987; Tokyo JP pp. 1722-1726; Y. Okamoto et al. 'DC gas-discharge display panel with LaB6 thin-film cathode' paragraph 2, FIG. 1.

*Primary Examiner*—Donald J. Yusko
*Assistant Examiner*—John E. Giust
*Attorney, Agent, or Firm*—Lowe, Price, LeBlanc & Becker

[57] ABSTRACT

A gas discharge-type display panel which comprises a front side glass substrate having a pattern of an anode on one side thereof and a rear side glass substrate having a pattern of a cathode in face-to-face and spaced relation with the anode. The substrates are assembled to seal off so that discharge spaces are created between the substrates. The cathode is made of a conductive composite oxide having a perovskite structure of a $K_2NiF_4$-type structure with significantly improved discharge characteristics and a prolonged life.

16 Claims, 2 Drawing Sheets

GAS DISCHARGE-TYPE DISPLAY PANEL COMPRISING A COMPOSITE OXIDE CATHODE

BACKGROUND OF THE INVENTION

1. Field of The Invention

This invention relates to a display device and more particularly, to a gas discharge-type display panel wherein patterns such as letters, figures and the like are displayed by utilization of gas discharge.

2. Description of The Prior Art

Cathodes of known gas discharge-type display panels are formed by screen printing a Ni paste on a glass substrate and firing the printed paste in air. Since the Ni paste can be readily fired in air, the formation is very easy. However, the Ni cathode is relatively high in firing potential and minimum discharge keeping potential and, thus, Ni is not necessarily satisfactory as a material for the cathode. In addition, when the discharge takes place, the Ni cathode is sputtered by the action of generated ions and is deposited on a front glass substrate on which an anode has been formed, with a lowering of light transmission and a reduction of brightness. This will shorten the life of the display panel. To solve the problem involved in the prior art display panels, attempts have been made to fabricate a cathode with a double-layer structure. In the cathode, Ni is provided as an underlying electrode on which a paste of a mixture of $LaB_6$ having a small work function and a small amount of alkali glass is screen printed and fired. This type of cathode is described, for example, in Technical Report IPD59-10 (1981) from the Television Society.

$LaB_6$ has a work function of 2.66 eV, which is smaller than 5.24 eV of the work function of Ni. If a cathode based on such a small work function can be formed, the resultant gas discharge-type display panel will have low firing potential and low minimum discharge keeping potential. However, $LaB_6$ is liable to form an oxide layer on the surface thereof. When $LaB_6$ is divided into fine particles having several micrometers in size, the area of the oxide layer increases with an increasing surface area. The total electric conductivity is eventually lowered considerably. Thus, the inherent characteristic of the $LaB_6$ cannot be developed when used in the form of fine particles.

In order to reduce the production costs of the panel, it is usual to employ soda glass as the substrate. The cathode is formed by a screen printing technique which is adapted for mass production. The printed layer is then fired in air. This inevitably involves oxidation of at least a part of $LaB_6$. As a result, the electric conductivity of the layer is lowered by not less than three orders of magnitude than the conductivity of $LaB_6$. This leads to the problem that the firing potential and the minimum discharge keeping potential become high and unstable.

To avoid the above problem, attempts have been made to fire in an inert gas such as argon, nitrogen or the like. The firing in an inert gas is effective when the particles of $LaB_6$ have a size of not smaller than several tens micrometers. However, little effect will not be expected when the particle size is as small as several micrometers or below.

SUMMARY OF THE INVENTION

It is accordingly an object of the invention to provide a gas discharge-type display panel which exhibits low firing potential and low minimum discharge keeping potential with improved discharge characteristics whereby a drive circuit for the panel becomes inexpensive and reliability of the panel is improved.

It is another object of the invention to provide a gas discharge-type display panel whose cathode has good electric conductivity and is unlikely to deposit on a front glass side by sputtering with ions generated as a result of discharge whereby a luminous efficiency of the display panel is improved.

The display panel of the invention is characterized by a cathode formed on a substrate in the form of a desired stripe pattern and made of a conductive composite oxide having a perovskite crystalline structure or a $K_2NiF_4$ crystalline structure.

More particularly, the display panel according to the invention comprising a first glass substrate, an anode formed on one side of the first glass substrate in a pattern, a second glass substrate, and a cathode formed on the second glass substrate in a pattern, the first glass substrate and the second glass substrate being assembled in air tight fashion in such a way that the anode and the cathode are in face-to-face and spaced relation to each other so that a multitude of display cells each having a discharge space therein are established in the panel. The cathode is made of a conductive composite oxide having a perovskite crystalline structure or a $K_2NiF_4$-type crystalline structure. An underlying electrode layer should preferably be provided between the glass substrate and the cathode in a pattern corresponding to that of the cathode in order to avoid a voltage drop when an electric current is applied to the anode and the cathode.

The patterns of the cathode and the anode are usually in a stripe form. As a matter of course, the stripes in the respective patterns are arranged to be intersected or crossed substantially at right angles if the anode and cathode patterns are superposed, as is well known in the art.

DETAILED DESCRIPTION AND EMBODIMENTS OF THE INVENTION

Figure 1:
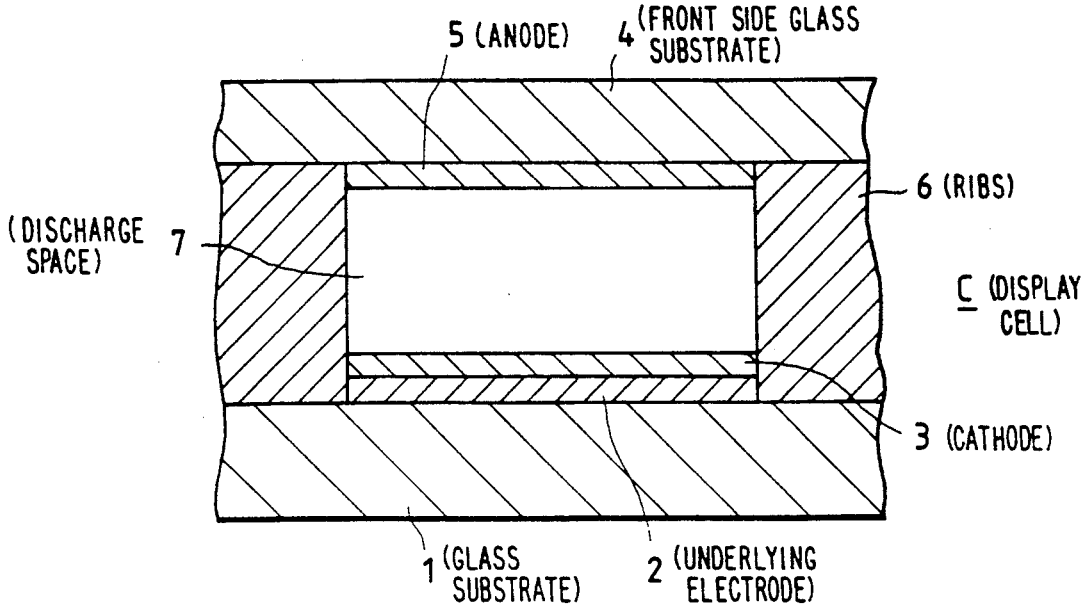
FIG. 1 is a schematic sectional view of one display cell used in a gas discharge-type display panel according to an embodiment of the invention.

Reference is now made to the accompanying drawings and particularly, to FIG. 1. In the figure, there is generally shown a display cell C of a gas discharge-type display panel. The cell C includes a rear side glass substrate 1 having a cathode 3. An underlying metal electrode 2 may be provided between the glass substrate 1 and the cathode 3. A front side glass substrate 4 having an optically transparent anode 5 on one side thereof is provided in parallel to the substrate 1 in such a way that the cathode 3 and the anode 5 are in face-to-face and spaced relation to each other through ribs 6 in an air-tight condition as shown. The space established between the cathode 3 and the anode 5 is a discharge space 7. A multitude of the cells partitioned with the ribs are contained in the panel.

The glass substrate 1 may be made of low melting glass materials such as soda glass, or the like.

The underlying electrode 2 is formed, if necessary, in a stripe pattern and is made, for example, of Ni, Ag, Pd, Pt, Al and/or Cu. The underlying electrode 2 made of such a metal as mentioned above has an electric conductivity larger by about two orders of magnitude than a composite oxide used as the cathode 3 of the invention. When the cathode 3 is formed as a stripe pattern without any underlying metal electrode and an electric current necessary for discharge is applied to the cathode, a voltage drop in the cathode may take place, resulting in an appreciable difference in brightness of emitted light. However, when the electrode 2 is formed as the underlying electrode, the voltage drop can be fully prevented with the brightness being uniform over the entirety of the cathode. Accordingly, the metal electrode is preferably formed between the substrate and the cathode in the form of a pattern corresponding to that of the cathode. If provided, the electrode 2 is generally in a thickness of from 3 to 300 μm.

The front side glass substrate 4 is made, for example, of soda glass, Pyrex glass, or the like.

The anode 5 is also formed in a stripe pattern on the substrate 4 generally in a thickness of from 3 to 300 μm. Examples of the material for the anode 5 may be those ordinarily used for this purpose and include, for example, indium tin oxide, Ni, Cu, Ag and the like. Preferably, the anode is made of an optically transparent material such as indium tin oxide.

The present invention is characterized by the cathode 3 formed on the metal electrode 2 as will be described in detail hereinafter.

The rear side glass substrate 1 having the metal electrode 2 and the cathode 3 thereon and the front side substrate 4 having the anode 5 are assembled at a spaced relation to each other through the ribs 6 made, for example, of lead glass or the like, in an airtight fashion by the use of glass frit. It will be noted that when the substrates 1 and 4 are assembled, the cathode 3 and the anode 5 are arranged to be facing each other. By this, the discharge space 7 is created between the substrates 1, 4. Moreover, the stripe patterns of the cathode 3 and the anode 5 are arranged to be intersected as superposed. After evacuation of each discharge space 7 through a port left in rear side substrate 1, a gas for the discharge is introduced into the space to a pressure of 100 to 500 Torr to complete a display panel having a multitude of the cells C. Examples of the gas include Ne, Xe, He, Kr, Ar or mixtures thereof.

The cathode 3 and anode 5 may be formed in any pattern ordinarily used in gas discharge display panels of the type to which the present invention is directed. For instance, a stripe pattern may be used. In the case, 400×640 dots each having a size of 200 μm×200 μm are formed at intervals between adjacent dots of about 300 μm. If the metal electrode 2 is used, this electrode is also patterned, on which the cathode is formed.

The cathode 3 is generally formed in a thickness of 3 to 300 μm.

In the practice of the invention, the cathode material should be a composite oxide having a perovskite crystalline structure or a $K_2NiF_4$ crystalline structure. Examples of the composite oxide having the perovskite crystalline structure include those composite oxides of the formula, $(LaM^1)M^2O_3$, wherein $M^1$ represents Ba or Sr, and $M^2$ represents at least one element selected from the group consisting of Co, Ni, Fe and Mn. Preferably, there are used those composite oxides of the formula, $(La_{1-x}M^1{}_x)M^2O_3$, wherein x is zero or in the range of from 0.1 to 0.6. More preferably, cobalitite of the formula, $(La_{1-x}Sr_x)CoO_3$, wherein x has the same meaning as defined above, is used. With cobaltite, if Fe is added instead of part of Co, adhesion to the glass substrate or the metal electrode can be improved. In the above formula, when x is zero, $LaM^2O_3$ is obtained. This type of perovskite compound is preferred because the conductivity is not influenced significantly by the variation in temperature.

Examples of the composite oxide having the $K_2NiF_4$ crystalline structure include those composite oxides of the formula, $(LaM^3)_2M^2O_4$, wherein $M^3$ represents Ba or Sr and $M^4$ represents at least one element selected from the group consisting of Cu and Ni. Preferably, the compounds of the formula, $(La_{1-y}M^3{}_y)_2M^4O_4$, wherein y is zero or in the range of from 0.05 to 0.5 are used. If y is zero, the compounds can be expressed as $La_2M^4O_4$. This type of compound is also preferably used.

The preparation of the perovskite or $K_2NiF_4$-type compounds is known in the art and is particularly described in examples appearing hereinafter.

The gas discharge-type display panel according to the invention is fabricated by the following procedure.

A powder of a composite oxide is mixed with a glass powder serving as a binder such as alkali glass and an organic liquid medium such as ethyl cellulose, polyvinyl butyral or the like dissolved in organic solvents, followed by breaking the particles into finer particles to obtain a paste with a given viscosity. The glass powder is generally used in an amount of from 5 to 20 wt % based on the total of the oxide powder and the glass powder.

A metal paste is initially screen printed on a rear side glass substrate 1 generally in a stripe pattern and fired to form an underlying electrode 2. Subsequently, the paste prepared above is screen printed to built up on the metal electrode pattern. After printing, the printed paste is dried at a relatively low temperature of about 100° C. in air and fired at a temperature of 550° to 660° C. in air for about 30 minutes, thereby forming a cathode 3.

Separately, a front side glass substrate 4 having an anode 5 in a similar stripe pattern which is preferably a transparent electrode and ribs 6 are provided. The substrate 4 and the substrate 1 are assembled so that the stripes of the anode and cathode patterns are crossed at right angles if the anode and the cathode are supreposed and are sealed off with glass frit by firing. Subsequently, the discharge spaces 7 created between the substrates 1, 4 are evacuated, after which Ne-Ar, He-Xe-Kr or the like gas is introduced into each space 7 at a pressure of 100 to 500 Torr.

The operation of the panel is well known in the art and is not described herein in detail. Briefly, the panel is connected to a drive circuit and potentials corresponding to information signals are applied intended intersections of the stripes of the respective patterns of the anode and the cathode to cause the gas discharge at the intersections to form a desired pattern.

The present invention is more particularly described by way of examples.

EXAMPLE 1

$La_{1-x}Sr_xCoO_3$ which is called cobaltite is used in this example as a conductive composite oxide. In the above formula, when x increases, an absolute value of conductivity increases. The temperature characteristic of the conductivity is changed from a semiconductive tendency toward a metallic tendency with an increase of x.

The semiconductive tendency is intended to mean a tendency of increasing conductivity with an increasing temperature. The metallic tendency means a tendency of decreasing conductivity with an increasing temperature.

For use as a cathode of a gas discharge tube, the temperature characteristic of conductivity of a cathode material should preferably be in a metallic tendency at a temperature in a discharged state. This is because if in a semiconductive tendency, the cathode is increased in temperature with an increase of the conductivity. The electric current is concentrated at a portion of the cathode which has a slightly high temperature. The portion in which the electric current has been concentrated becomes higher in temperature. If a positive feedback works as set forth above, a uniform discharge does not take place but a discharge region is concentrated at a portion, resulting in a considerable lowering of the display quality. In contrast, with a cathode showing a metallic tendency, a negative feedback works, so that such a concentration of the discharge as set out above does not occur.

With cobaltite, the metallic tendency is shown in a high temperature range of not lower than several hundreds centigrades irrespective of the value of x. In the cobaltite of the above formula where x is 0, 0.1, 0.2 or 0.3, the conductivity is in a semiconductive tendency at room temperature and the temperatures at which the conductivity becomes maximal are, respectively, 700° C., 500° C., 400° C. and 300° C. Thus, the temperatures are shifted toward a lower side with an increase in amount of Sr. Further, when x is in the range of from 0.1 to 0.6, all cobaltite compositions exhibit a metallic tendency at room temperature. However, a larger value of x is disadvantageous in that deficiencies of oxygen are liable to occur with the discharge becoming unstable. Accordingly, a preferable range of x is from 0.3 to 0.8.

In this example, cobaltite with La=0.5 and Sr=0.5 is described.

Solutions of nitrates of La, Sr and Co were, respectively, provided as starting materials and mixed at ratios of La=0.5, Sr=0.5 and Co=1. The mixture was dropped into a mixed solution of oxalic acid and ethanol to obtain precipitates of the respective metal oxalates. The precipitates were dried at 70° C. and the dried solid matters were mixed together, followed by heating in air by the use of an electric furnace at 500° C. for 3 hours, thereby thermally decomposing the oxalates into oxides of La, Sr and Co.

The oxides were fired at a temperature of 1300° C. for 5 hours in a stream of oxygen at a rate of 300 cc/minute, thereby obtaining a complete perovskite crystalline structure. The powder obtained after the firing was in the form of ljmps, which were ground by means of a mortar or ball mill to obtain fine particles having a size or not larger than several micrometers.

The thus obtained particles were subjected measurement of electric conductance along with conventionally employed $LaB_6$ powder. Since the measurement of an absolute value of the electric conductance in the form of powder is difficult, a relative specific resistance is shown. For the measurement of the specific resistance, the powder was pressed in the form of a pellet at a compression pressure of 1000 kg/cm$^2$. For convenience' sake, the specific resistance was calculated from the size of the pellet and the resistance across the pellet.

When the relative specific resistance of a $LaB_6$ powder having a size of 325 mesh is taken as 1, the relative specific resistance of a 4000 mesh size powder was about 1000 and is greater by three orders of magnitude.

In contrast, a relative specific resistance of the cobaltite was 0.1, which is smaller by one order of magnitude.

The cobaltite powder was mixed with 5 wt % of an alkali glass powder and 20 wt % of an organic solvent by a three-roll mill to obtain a paste.

A Ni paste was screen printed on a rear side glass substrate in a cathode pattern and fired to form a Ni underlying electrode. The paste obtained above was formed on the cathode pattern by screen printing. After the printing, the paste was dried at 100° C. in air and fired at a temperature of from 550° to 660° C. for 30 minutes. The rear side glass substrate having the cathode was assembled with a front side glass substrate having an anode in a pattern and ribs so that display cells were formed between the substrates, followed by sealing off with glass frit. Ne-Ar or He-Xe gas was introduced at 250 Torr, thereby fabricating a gas discharge-type display panel having a great number of the cells.

The above procedure was repeated using Ni and $LaB_6$ wherein with Ni, any further underlying layer was formed and with $LaB_6$, a Ni underlying layer was provided between the substrate and the $LaB_6$, thereby fabricating similar panels.

Figure 2:
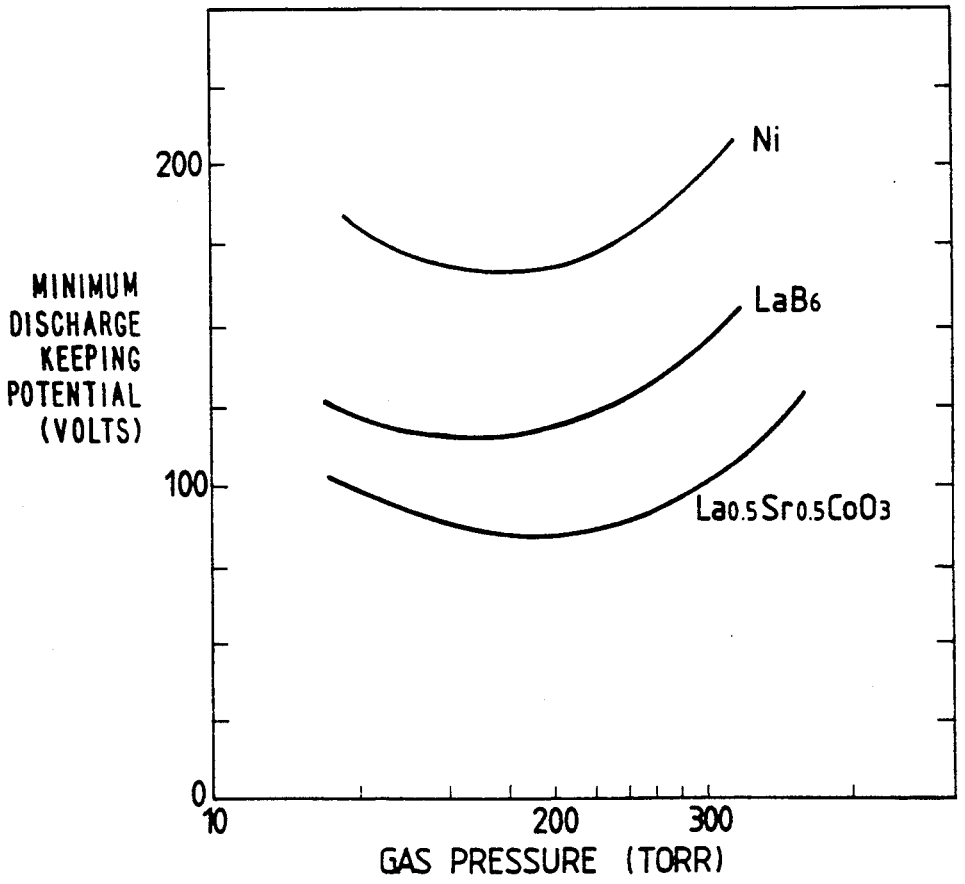
FIGS. 2 and 3 are, respectively, a graph showing the relation between the minimum discharge keeping potential and the pressure of a gas for cathodes made of different materials of the invention and for comparison.

These panels were subjected to measurement of a discharge characteristic using Ne or Kr as a discharge gas. The results are shown in FIG. 2 wherein the minimum discharge keeping potential is depicted in relation to the gas pressure.

As will be apparent from the figure, the cobaltite cathode is significantly lower in the potential than the Ni cathode or the $LaB_6$ cathode formed in the Ni underlying electrode.

In addition, the panel brightness after discharge over 1000 hours was also determined. When the brightness of the Ni cathode was taken as 100, the cobaltite cathode was 150, which is 1.5 times greater.

EXAMPLE 2

$(La_{2-x}Sr_x)CuO_4$ which is a typical oxide of the $K_2NiF_4$ type is described. In this type of oxide, the conductivity varies depending on the value of x. For instance, when x is 0.1, 0.2, 0.3, 0.4 or 0.5, the conductivity is, respectively, 188, 676, 526, 403 or 225 S/cm, revealing that the maximum conductivity is at 0.2.

In this example, an oxide of the above formula where La=1.8, Sr=0.2 and Cu=1.0 is described.

In the same manner as in Example 1, fine powder was obtained by co-precipitation. More particularly, nitrate solutions of La, Sr and Cu were mixed at ratios of La=1.8, Sr=0.2 and Cu=1 and dropped into a mixed solution of oxalic acid and ethanol to obtain precipitates of oxalates. The precipitates were dried and mixed to obtain a powder. The co-precipitate was thermally decomposed at 500° C. for 3 hours to obtain oxides of La, Sr and Cu. The oxides were fired at a temperature of 1100° C. for 5 hours in a stream of oxygen, thereby obtaining a product with a complete $K_2NiF_4$-type crystalline structure. The product was divided into fine particles with a size of several micrometers. The fine particles were mixed with an alkali glass powder and an organic liquid medium so as to adjust the viscosity appropriately, followed by kneading with a three-roll mill to obtain a paste.

The paste was screen printed on a Ag underlying electrode which had been separately formed on a glass substrate, thereby obtaining a rear side glass substrate. Subsequently, the procedure of Example 1 was repeated wherein Ne gas was introduced into the discharge space, thereby obtaining a display panel.

Figure 3:
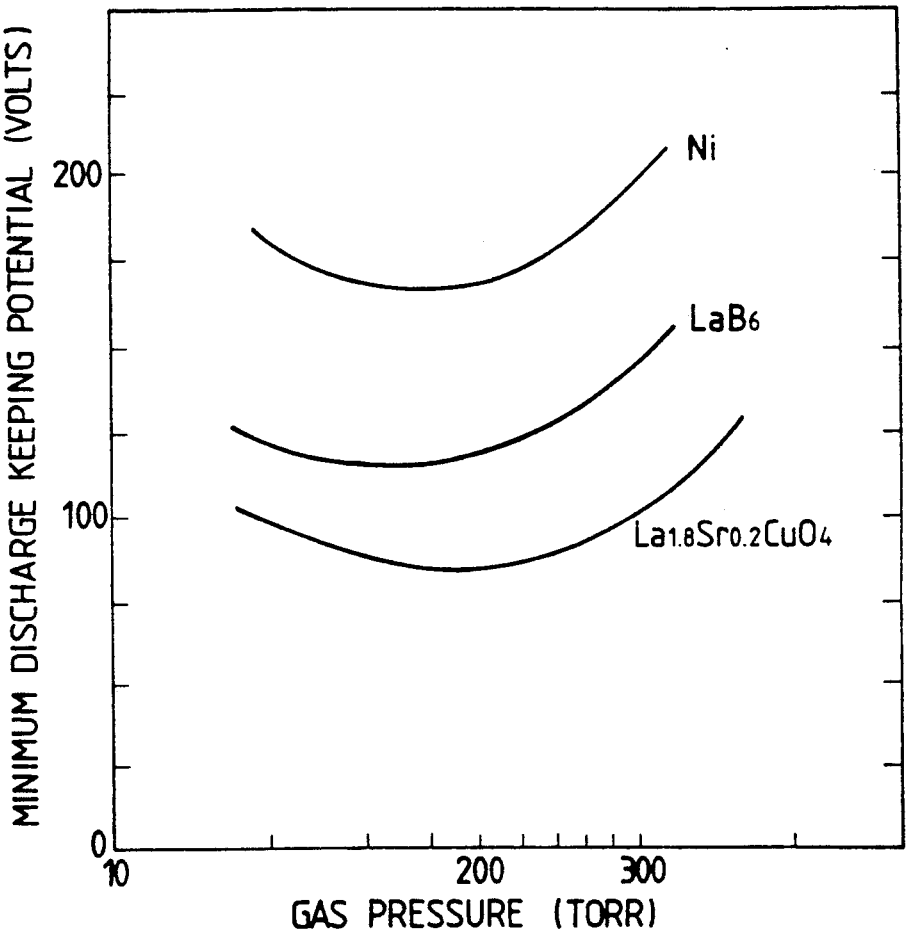

The display panel was subjected to measurement of a discharge characteristic, along with the panels having, respectively, the Ni and $LaB_6$ cathodes each formed on the Ni underlying electrode. The results are shown in FIG. 3. As will be apparent from FIG. 3, the panel using the $La_{1.8}Sr_{0.2}CuO_4$ cathode is significantly lower than those for comparison with respect to the minimum discharge keeping electrode.

EXAMPLE 3

A perovskite composite oxide of the formula, $(LaM^1)M^2O_3$, wherein $M^1$ is Ba and $M^2$ is Co is described.

As a result of an experiment where the relation between the amount of substituted Ba and the conductivity or firing conditions was checked, the composition capable of achieving a maximum conductivity was found to be $La_{0.5}Ba_{0.5}CoO_3$. As compared with Sr as $M^1$, the case using Ba required a slightly higher firing temperature. In this connection, similar performances were obtained at firing temperatures of not lower than 1100° C. For instance, when the firing temperature was 1000° C., the conductivity was 850 S/cm for Sr and 180 S/cm for Ba. At 1100° C., the conductivity was 2330 S/cm for Sr and 2130 S/cm for Ba. Thus, firing at temperatures of not lower than 1100° C. was found to be appropriate.

In the same manner as in Example 1 using barium nitrate, fine powder was made by co-precipitation, followed by firing at 1200° C. for 5 hours in a stream of oxygen, thereby obtaining a conductive composite oxide having a complete perovskite structure.

The oxide was powdered into fine particles with a size of not larger than several micrometers, followed by mixing with an alkali glass powder and organic liquid medium to have an appropriate viscosity and kneading by a three-roll mill to obtain a paste.

The paste was screen printed on a Ag underlying electrode which had been separately formed on a substrate. Then, the procedure of Example 1 was repeated, thereby fabricating a gas discharge panel. The measurement of the panel along with those for comparison revealed that the minimum discharge keeping potential was significantly lower than those of the panels using the Ni cathode and the $LaB_6$ cathode formed on the Ni underlying electrode.

EXAMPLE 4

A perovskite composite oxide of the formula, $(LaM^1)M^2O_3$, wherein $M^1$ is Sr and $M^2$ is a mixture of Co and Fe is described.

$(LaSr)CoO_3$ has good cathode characteristics but is relatively poor in adhesion to a glass substrate or a metal electrode. When Fe is added, the adhesion force is improved. The amount of substituted Fe should be at a level not impeding the conductivity. In this sense, $La_{0.5}Sr_{0.5}Co_{0.7}Fe_{0.3}O_3$ was used in this example.

In the same manner as in Example 1 using nitrates of La, Sr, Co and Fe, fine powder was prepared by co-precipitation and fired at 1200° C. for 5 hours, followed by powdering, making a paste and formation of a cathode. As a result, it was found that the separation of the cathode was significantly reduced over Fe-free cathodes with similar discharge characteristics.

The panel using the $La_{0.5}Sr_{0.5}Co_{0.7}Fe_{0.3}O_3$ cathode was significantly improved over the known panels using the Ni cathode and the $LaB_6$ cathode formed on the Ni underlying electrode with respect to the minimum discharge keeping potential.

EXAMPLE 5

A perovskite composite oxide of the formula, $(LaM^1)M^2O_3$, wherein $M^1$ is Sr and $M^2$ is Mn is described.

Aside from the discharge keeping potential, a life of the cathode is important. The life of the cathode is greatly influenced by sputtering of the cathode with discharged ions. When the cathode is sputtered, a sputtered conductive material is deposited around the inner side of the panel, degrading insulation between the anode and the cathode. When the front glass is deposited with the sputtered matter, light transmittance is lowered with a lowering of brightness. When Mn was used as $M^2$, the resultant perovskite compound was found to become very resistant to sputtering upon discharge. In addition, such a perovskite compound had similar discharge characteristics as $(LaSr)CoO_3$.

In the same manner as in Example 1 using nitrates of La, Sr and Mn and a Ag underlying electrode, a gas discharge panel was fabricated. The panel using the $LaSrMnO_3$ cathode was significantly improved over the known panels using the Ni cathode and the $LaB_6$ cathode formed on the Ni underlying electrode with respect to the minimum discharge keeping potential.

EXAMPLE 6

A perovskite composite oxide of the formula, $(LaM^1)M^2O_3$, wherein $M^1$ is absent and $M^2$ is Ni, i.e. $LaNiO_3$, is described.

This perovskite compound exhibited little variation of the conductivity in relation to the temperature. For instance, the conductivity was 200 S/cm at 50° C., 180 S/cm at 120° C. and 200 S/cm at 180° C., giving evidence that the compound had very high thermal stability.

In the same manner as in Example 1 using nitrates of La and Ni, fine powder was prepared by co-precipitation and fired at 1200° C. for 5 hours, followed by powdering, making a paste and formation of a cathode on a Ag underlying electrode, thereby making a gas discharge panel. The panel using the $LaNiO_3$ cathode was significantly improved over the known panels using the Ni cathode and the $LaB_6$ cathode formed on the Ni underlying electrode with respect to the minimum discharge keeping potential.

EXAMPLE 7

A $K_2NiF_4$-type composite oxide of the formula, $(LaM^3)M^4O_3$, wherein $M^3$ is Sr and $M^3$ is Ni is described. In this compound, when the amount of substituted Sr was increased, the conducitivity characteristic was changed from a semiconductive tendency toward a metallic tendency in relation to the temperature. At the same time, the absolute value of the conductivity was also increased. An optimum composition was found to be $La_{1.8}Sr_{0.2}NiO_4$. The conductivity was 70 S/cm.

In the same manner as in Example 1 using nitrates of La, Sr and Ni, fine powder was made by co-precipitation, followed by firing at 1300° C. for 5 hours in a stream of oxygen, thereby obtaining a conductive composite oxide having a complete $K_2NiF_4$ structure.

The oxide was powdered into fine particles with a size of not larger than several micrometers, followed by mixing with an alkali glass powder and organic liquid medium to have an appropriate viscosity and kneading by a three-roll mill to obtain a paste.

The paste was screen printed on a Ag underlying electrode which had been separately formed on a substrate. Then, the procedure of Example 1 was repeated, thereby fabricating a gas discharge panel. The measurement of the panel along with those for comparison revealed that the minimum discharge keeping potential was significantly lower than those of the panels using the Ni cathode and the $LaB_6$ cathode formed on the Ni underlying electrode.

EXAMPLE 8

A $K_2NiF_4$-type composite oxide of the formula, $(LaM^3)M^4O_4$, wherein $M^3$ is nil and $M^4$ is Ni, i.e. $LaNiO_4$, is described.

The conductivity varies relatively greatly depending on the temperature in the range of from room temperature to 100° C. and is relatively stabilized at higher temperatures. For instance, the conductivity was 15 S/cm at 20° C., 18 S/cm at 80° C., 50 S/cm at 140° C., and 50 S/cm at 200° C.

In the same manner as in Example 1 using nitrates of La and Ni, fine powder was prepared from co-precipitates and fired at 1200° C. for 5 hours in a stream of oxygen to obtain a conductive oxide having a $K_2NiF_4$ structure. The oxide was powdered to obtain particles with a size of not larger than several micrometers, followed by mixing with an alkali glass powder and organic liquid medium to have an appropriate viscosity and kneading by a three-roll mill to obtain a paste.

The paste was screen printed on a Ag underlying electrode which had been separately formed on a substrate. Then, the procedure of Example 1 was repeated, thereby fabricating a gas discharge panel. The measurement of the panel using the $La_2NiO_4$ cathode along with those for comparison revealed that the minimum discharge keeping potential was significantly lower than those of the panels using the Ni cathode and the $LaB_6$ cathode formed on the Ni underlying electrode.

As will be apparent from the above examples, the composite oxides having a perovskite structure or a $K_2NiF_4$-type structure are excellent in discharge characteristics and sputtering resistance with an improved luminous efficiency.

The conductive composite oxides used in the present invention have a high electron radiation rate and are resistant to sputtering with ions, and are thus very suitable for use as a cathode.

What is claimed is:

1. A gas discharge-type display panel comprising a first glass substrate, an anode formed on one side of the first glass substrate in a pattern, a second glass substrate, and a cathode formed on the second glass substrate in a pattern, the first substrate and the second substrate being assembled in air tight fashion in such a way that the anode and the cathode are in face-to-face and spaced relation to each other so that a multitude of display cells, each having a discharge space therein, are established in the panel, said cathode being made of a conductive composite oxide of the formula, $(LaM^1)M^2O_3$, wherein $M^1$ represents Ba or Sr, and $M^2$ represents at least one element selected from the group consisting of Co, Ni, Fe and Mn.

2. The panel according to claim 1, wherein said conductive composite oxide is of the formula, $(La_{1-x}M^1_x)M^2O_3$, and x is in the range of from 0.1 to 0.6.

3. The panel according to claim 2, wherein said conductive composite oxide is a cobaltite of the formula, $(La_{1-x}Sr_x)CoO_3$, wherein x is in the range of from 0.1 to 0.6.

4. The panel according to claim 3, wherein part of Co in the formula is replaced by Fe.

5. The panel according to claim 1, wherein said cathode comprises a glass component as a binder.

6. The panel according to claim 1, further comprising a metal electrode in the same pattern as said cathode provided between said cathode and said second glass substrate.

7. The panel according to claim 6, wherein said metal electrode is made of at least one metal selected from the group consisting of Ni, Ag, Pd, Pt, Al and Cu.

8. The panel according to claim 1, wherein said anode is optically transparent.

9. A gas discharge-type display panel comprising a first glass substrate, an anode formed on one side of the first glass substrate in a pattern, a second glass substrate, and a cathode formed on the second glass substrate in a pattern, the first glass substrate and the second glass substrate being assembled in air tight fashion in such a way that the anode and the cathode are in face-to-face and spaced relation to each other so that a multitude of display cells, each having a discharge space therein, are established in the panel, said cathode being made of a conductive composite oxide of the formula, $(LaM^3)_2M^4O_4$, wherein $M^3$ represents Ba or Sr and $M^4$ represents at least one element selected from the group consisting of Cu and Ni.

10. The panel according to claim 9, wherein said conductive composite oxide is of the formula, $(La_{1-y}M^3_y)_2M^4O_4$, wherein y is in the range of from 0.05 to 0.5.

11. The panel according to claim 9, wherein said cathode comprises a glass component as a binder.

12. The panel according to claim 9, further comprising a metal electrode in the same pattern as said cathode provided between said cathode and said second glass substrate.

13. The panel according to claim 12, wherein said metal electrode is made of at least one metal selected from the group consisting of Ni, Ag, Pd, Pt, Al and Cu.

14. The panel according to claim 9, wherein said anode is optically transparent.

15. A gas discharge-type display panel comprising a first glass substrate, an anode formed on one side of the first glass substrate in a pattern, a second glass substrate, and a cathode formed on the second glass substrate in a pattern, the first substrate and the second substrate being assembled in air tight fashion in such a way that the anode and the cathode are in face-to-face and spaced relation to each other so that a multitude of display cells, each having a discharge space therein, are established in the panel, said cathode being made of a conductive composite oxide of the formula, $LaM^2O_3$, wherein $M^2$ represents at least one element selected from the group consisting of Co, Ni, Fe and Mn.

16. A gas discharge-type display panel comprising a first glass substrate, an anode formed on one side of the first glass substrate in a pattern, a second glass substrate, and a cathode formed on the second glass substrate in a pattern, the first glass substrate and the second glass substrate being assembled in air tight fashion in such a way that the anode and the cathode are in face-to-face and spaced relation to each other so that a multitude of display cells, each having a discharge space therein, are established in the panel, said cathode being made of a conductive compsite oxide of the formula, $La_2M^4O_4$, wherein $M^4$ represents at least one element selected from the group consisting of Cu and Ni.

* * * * *